US011599052B2

(12) United States Patent
Hatano

(10) Patent No.: US 11,599,052 B2
(45) Date of Patent: Mar. 7, 2023

(54) IMAGE FORMING APPARATUS

(71) Applicant: CANON KABUSHIKI KAISHA, Tokyo (JP)

(72) Inventor: Fukashi Hatano, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/573,341

(22) Filed: Jan. 11, 2022

(65) Prior Publication Data

US 2022/0244671 A1 Aug. 4, 2022

(30) Foreign Application Priority Data

Jan. 29, 2021 (JP) ..... JP2021-013604

(51) Int. Cl.
*G03G 15/00* (2006.01)
*G03G 15/16* (2006.01)

(52) U.S. Cl.
CPC ..... *G03G 15/55* (2013.01); *G03G 15/161* (2013.01)

(58) Field of Classification Search
CPC ..... G03G 15/55; G03G 15/161
See application file for complete search history.

(56) References Cited

U.S. PATENT DOCUMENTS

| | | | | |
|---|---|---|---|---|
| 7,174,264 | B2 | 2/2007 | Yasukawa et al. | |
| 8,107,848 | B2 | 1/2012 | Nozawa et al. | |
| 2015/0104213 | A1* | 4/2015 | Tajiri | G03G 15/1615 399/121 |
| 2015/0277320 | A1* | 10/2015 | Tani | G03G 15/5054 399/74 |

FOREIGN PATENT DOCUMENTS

| | | | |
|---|---|---|---|
| JP | 2005-033559 | A | 2/2005 |
| JP | 2009-223042 | A | 10/2009 |
| JP | 2009-294435 | A | 12/2009 |
| JP | 2017-187605 | A | 10/2017 |

* cited by examiner

*Primary Examiner* — Clayton E. LaBalle
*Assistant Examiner* — Michael A Harrison
(74) *Attorney, Agent, or Firm* — Venable LLP

(57) ABSTRACT

An optical sensor irradiates a control toner image formed on an intermediate transfer belt with light and detects reflection light of the light. A controller executes an abnormality diagnosis mode in a case where change in the phase of a cam is not detected by a phase detection portion until an elapse of a predetermined time or more since a start of output of a driving signal for driving a separation mechanism. In execution of the abnormality diagnosis mode, the controller outputs the driving signal for driving the separation mechanism, and is capable of outputting information about an abnormality of the phase detection portion and information about an abnormality of the separation mechanism and/or a driving unit on a basis of a detection result of the optical sensor that is obtained in a case where the light is radiated from the optical sensor while the driving signal is output.

7 Claims, 15 Drawing Sheets

IMAGE FORMING APPARATUS

BACKGROUND OF THE INVENTION

Field of the Invention

The present invention relates to an image forming apparatus such as a copier, a printer, a facsimile machine, or a multifunctional apparatus having a plurality of functions of these.

Description of the Related Art

As an image forming apparatus, a configuration of an intermediate transfer system in which a toner image is transferred from a photosensitive drum as an image bearing member onto an intermediate transfer belt is known. In an image forming apparatus having such a configuration including an intermediate transfer belt, for example, a configuration in which the intermediate transfer belt is separated from the photosensitive drum for, for example, replacing an intermediate transfer unit including the intermediate transfer belt is conventionally known.

Here, in the case where the separation of the intermediate transfer belt is not performed, it is desired that an error warning is issued. As a configuration for making an error determination like this, for example, a configuration in which a signal of a normal state of a drive source such as a motor or a solenoid is stored in advance, and diagnosis of presence or absence of an error and details of the error is performed by comparing a signal at the occurrence of the error with the signal of the normal state is proposed in Japanese Patent Laid-Open No. 2005-33559.

Here, regarding a separation error of the intermediate transfer belt, it is difficult to determine which unit is malfunctioning from just a signal of the drive source. For example, in the case where a drive train that transmits a drive from the drive source is locked and the drive source stops operating, the signal is no longer received and thus it is impossible to make the determination. In addition, even if the signal changes as a result of increase in the load on the drive train, it is difficult to determine in which unit the increase in the load has occurred.

If the determination on where the malfunction has occurred is not made quickly, not only the restoration of the apparatus takes time, but also a unit that is not necessary for the restoration has to be brought, and thus a transport load for a service person is increased. In addition, sometimes a unit that is not needed to be replaced is replaced, which is a waste of resources.

Although adding a sensor for determining where the malfunction has occurred can be also considered, if a sensor is added, the cost increases.

SUMMARY OF THE INVENTION

The present invention provides a configuration in which where a malfunction has occurred can be determined without additionally providing a sensor in the case where a separation error of an intermediate transfer belt has occurred.

According to one aspect of the present invention, an image forming apparatus includes an image bearing member configured to bear a toner image, an intermediate transfer belt configured to bear the toner image transferred from the image bearing member, a separation mechanism configured to separate the intermediate transfer belt from the image bearing member, a driving unit configured to drive the separation mechanism, a cam configured to be driven by the driving unit to operate the separation mechanism, a phase detection portion configured to detect a phase of the cam, an optical sensor configured to irradiate a control toner image formed on the intermediate transfer belt with light and detect reflection light of the light, the optical sensor being configured such that a distance between the optical sensor and the intermediate transfer belt changes in accordance with an operation of the separation mechanism, and, a controller configured to execute an abnormality diagnosis mode in a case where change in the phase of the cam is not detected by the phase detection portion until an elapse of a predetermined time or more since a start of output of a driving signal for driving the separation mechanism. In execution of the abnormality diagnosis mode, the controller outputs the driving signal for driving the separation mechanism, and is capable of outputting information about an abnormality of the phase detection portion and information about an abnormality of the separation mechanism and/or the driving unit on a basis of a detection result of the optical sensor that is obtained in a case where the light is radiated from the optical sensor while the driving signal is output.

Further features of the present invention will become apparent from the following description of exemplary embodiments with reference to the attached drawings.

DESCRIPTION OF THE EMBODIMENTS

Figure 1:
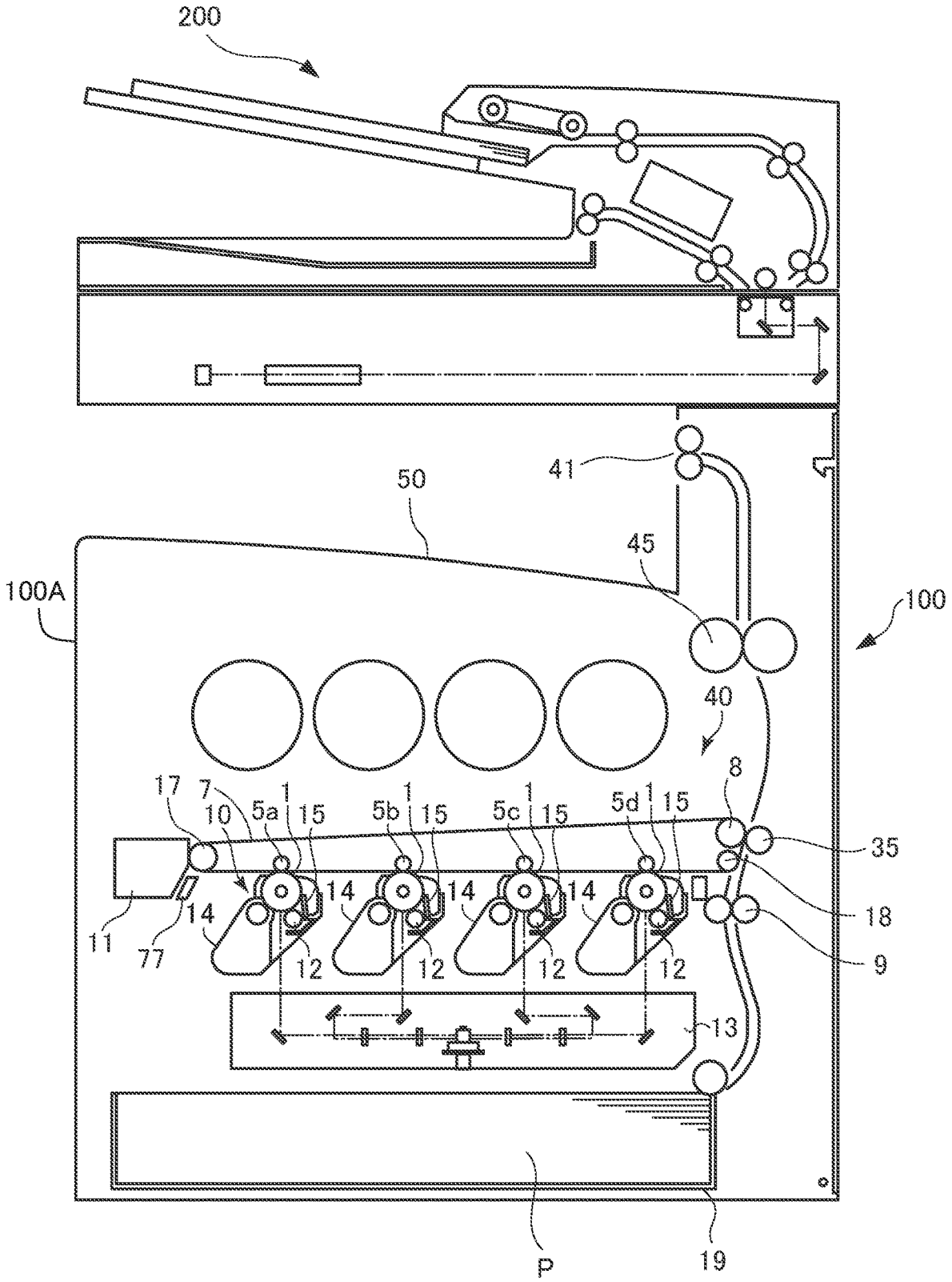
FIG. 1 is a schematic section view of an image forming apparatus according to an embodiment illustrating a configuration thereof.

An embodiment will be described with reference to FIGS. 1 to 15. First, a schematic configuration of an image forming apparatus according to the present embodiment will be described with reference to FIG. 1.

Image Forming Apparatus

An image forming apparatus 100 is a laser beam printer of a tandem type employing an intermediate transfer system capable of forming a full-color image by using an electrophotographic system. The image forming apparatus 100 forms a toner image on a recording material in accordance with an image signal received from a document reading apparatus 200 connected to an apparatus body 100A or a host device such as a personal computer communicably connected to the apparatus body 100A. Examples of the recording material include sheet materials such as paper sheets, plastic films, and cloths.

The image forming apparatus 100 includes image forming portions 10 of respective colors of Y, M, C, and Bk, which respectively represent yellow, magenta, cyan, and black. The image forming portions 10 each include a photosensitive drum 1 that is an electrophotographic photoconductor of a drum shape or a cylindrical shape serving as an image bearing member. To be noted, in the present embodiment, the photosensitive drum 1 of the image forming portion 10 of Bk corresponds to a first image bearing member, and the photosensitive drums 1 of the image forming portions 10 of Y, M, and C each correspond to a second image bearing member. The photosensitive drum 1 is rotationally driven in a clockwise direction in FIG. 1. A charging roller 12 that is a charging member of a roller shape serving as a charging portion, a developing unit 14 serving as a developing portion, and a drum cleaning unit 15 serving as a cleaning portion are disposed around the photosensitive drum 1. In addition, an exposing unit 13 serving as an exposing portion is disposed below the photosensitive drums 1. In the present embodiment, the exposing unit 13 is a laser scanner. Further, a belt unit 40 is disposed above the photosensitive drums 1.

The belt unit 40 includes an intermediate transfer belt 7 that is an endless belt serving as an intermediate transfer member such that the intermediate transfer belt 7 opposes the photosensitive drums 1 serving as a plurality of image bearing members. The intermediate transfer belt 7 is stretched over a driving roller 8, a driven roller 18, and a tension roller 17 serving as a plurality of stretch rollers. The intermediate transfer belt 7 rotates or circulates in a counterclockwise direction in FIG. 1 by being rotationally driven by the driving roller 8. Primary transfer rollers 5*a*, 5*b*, 5*c*, and 5*d* serving as a plurality of transfer rollers are disposed at positions respectively corresponding to the photosensitive drums 1 on the inner circumferential side of the intermediate transfer belt 7. Details of the configuration of the belt unit 40 will be described later.

The surface of the photosensitive drum 1 is uniformly charged by the charging roller 12, and then a latent image is formed on the photosensitive drum 1 by the exposing unit 13 driven on the basis of a signal of received image information. The latent image is visualized as a toner image by a developing unit 14. The toner images on the photosensitive drums 1 are sequentially transferred onto the intermediate transfer belt 7 through primary transfer as a result of a predetermined pressurizing force and electrostatic load bias being applied by the primary transfer rollers 5*a* to 5*d*. After the transfer, residual toner of a small amount remaining on the photosensitive drums 1 is removed and collected by the drum cleaning units 15 to be prepared for next image formation.

Meanwhile, recording materials P are fed one by one from a feeding cassette 19, and are conveyed to a registration roller pair 9. The skew of the recording material P is corrected by forming a loop by aligning the leading end of the recording material P with a nip portion of the registration roller pair 9. Then, the registration roller pair 9 conveys the recording material P to a secondary transfer nip portion formed between the intermediate transfer belt 7 and a secondary transfer outer roller 35 in synchronization with the toner image on the intermediate transfer belt 7.

The secondary transfer nip portion is a portion where the recording material P is nipped and conveyed between the outer circumferential surface of the intermediate transfer belt 7 stretched by a driving roller serving as a secondary transfer inner roller, and the secondary transfer outer roller 35. The color toner image on the intermediate transfer belt 7 is transferred onto the recording material P through secondary transfer as a result of receiving a predetermined pressurizing force and electrostatic load bias in the secondary transfer nip portion. After the transfer, the residual toner of a small amount remaining on the intermediate transfer belt 7 is removed and collected by a transfer cleaning unit 11 to be prepared for next image formation again. The toner image transferred onto the recording material P is fixed by being heated and pressurized by a fixing unit 45, and the recording material P is discharged onto a discharge tray 50 by a discharge roller pair 41.

Belt Unit

Figure 2:
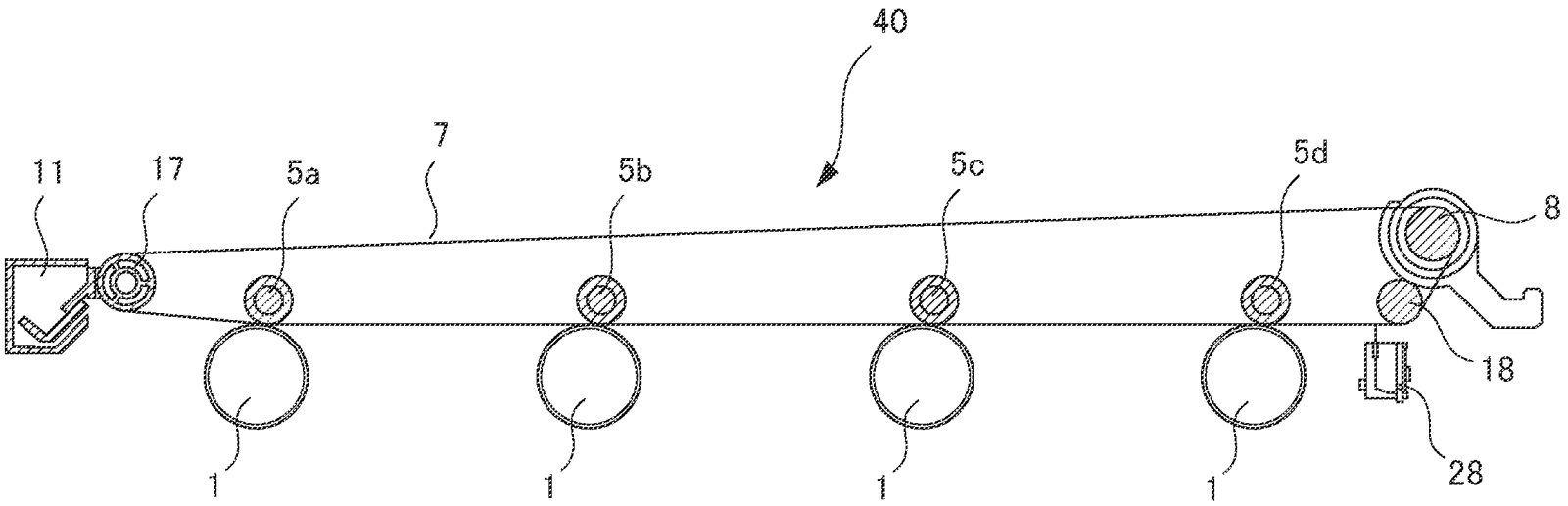
FIG. 2 is a schematic section view of a belt unit according to the embodiment in an operating state illustrating a configuration thereof.
Figure 3:
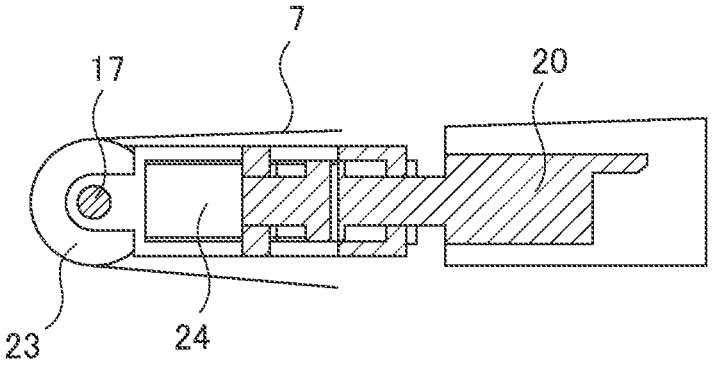
FIG. 3 is a section view of a tension roller part according to the embodiment.

Next, the belt unit 40 will be described with reference to FIGS. 2 to 4. First, the overall configuration of the belt unit 40 will be described. The belt unit 40 includes the intermediate transfer belt 7, the driving roller 8 for driving the intermediate transfer belt 7, the driven roller 18 that is rotated in accordance with the rotation of the intermediate transfer belt 7, and the tension roller 17. These three rollers serve as a plurality of stretching members for stretching the intermediate transfer belt 7.

The driving roller 8 includes a thin rubber layer on the surface thereof, and each end thereof in the longitudinal direction serving as a rotation axis direction is rotatably supported by an intermediate transfer frame 20 illustrated in FIGS. 3 and 6 that will be described later via a bearing. The driven roller 18 is rotatably supported by driven roller bearings 21 illustrated in FIG. 7 and the like that will be described later pivotably supported by the intermediate transfer frame 20. As illustrated in FIG. 3, each end of the tension roller 17 in the longitudinal direction is rotatably supported by a tension roller bearing 23, and a belt tension spring 24 is disposed between the tension roller bearing 23 and the intermediate transfer frame 20. The tension roller bearing 23 and the intermediate transfer frame 20 are slidably supported in the action direction of the belt tension spring 24, and the tension roller 17 stretches the intermediate transfer belt 7. The tension roller 17 is urged toward the outer circumferential side from the inner circumferential side of the intermediate transfer belt 7, and a predetermined tension is applied to the intermediate transfer belt 7 by the tension roller 17.

The primary transfer rollers 5*a* to 5*d* are disposed to oppose the photosensitive drums 1 with the intermediate transfer belt 7 therebetween, and are pressed against the photosensitive drums 1 while being translationally movably or pivotably supported by primary transfer holders 25*a* to 25*d* illustrated in FIG. 7 that will be described later. As illustrated in FIGS. 4A, 4B, and 9A to 9C that will be described later, the primary transfer holders 25*a* to 25*d* are respectively provided with protrusion portions 25*e* to 25*h*.

Figure 4A:
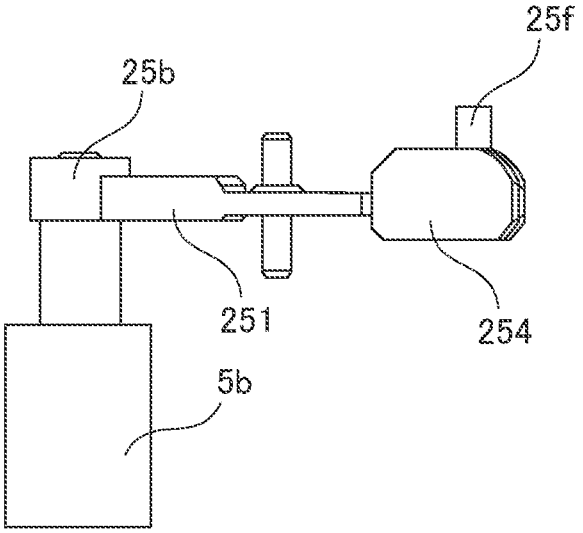
FIG. 4A is a plan view of an element that pivotably supports a primary transfer roller.
Figure 4B:
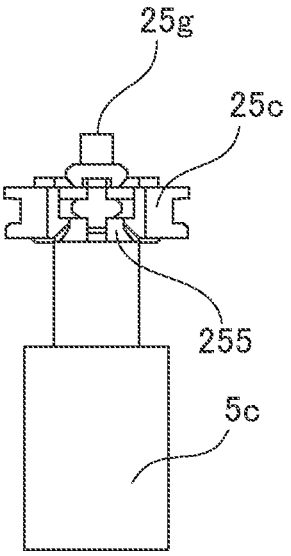
FIG. 4B is a plan view of an element that translationally movably supports the primary transfer roller.

FIG. 4A illustrates the primary transfer holder 25*b* as a representative, and the same applies to the primary transfer holder 25*a*. In addition, FIG. 4B illustrates the primary transfer holder 25*c* as a representative, and the same applies to the primary transfer holder 25*d*. As illustrated in FIG. 4A, the protrusion portion 25*f* is provided so as to project parallel to the rotation axis direction of the primary transfer roller 5*b* from a spring bearing portion 254 of an arm portion 251. Meanwhile, as illustrated in FIG. 4B, the protrusion portion 25*g* is provided to project parallel to the rotation axis direction of the primary transfer roller 5*c* from a bearing portion 255.

In the present embodiment, the intermediate transfer belt 7 is an endless belt formed from polyether ether ketone (PEEK) and having a circumferential length of 791.9 mm, a width of 346 mm, and a thickness of 48 μm. The material for the intermediate transfer belt 7 is not limited to this. For example, in place of the one described above, the intermediate transfer belt 7 formed from polyimide, polycarbonate, polyvinylidene fluoride (PVDF), tetrafluoroethylene-ethylene copolymer (ETFE), or polytetrafluoroethylene (PTFE) can be preferably used.

A rib is provided at each end of the intermediate transfer belt 7 in a direction approximately perpendicular to the conveyance direction, that is, at each end of the intermediate transfer belt 7 in the width direction or the longitudinal direction approximately perpendicular to the circulating direction, on the inner circumferential side of the intermediate transfer belt 7. In the present embodiment, the rib is a protrusion extending in a direction approximately perpendicular to the belt surface and extending over the entire circumference of the intermediate transfer belt 7. The rib is formed from urethane and has a width of 3 mm and a height of 1.2 mm. In addition, a patch sensor unit 28 serving as a registration patch detection sensor unit that is used for color correction and density adjustment is disposed at a position opposing the driven roller 18 with the intermediate transfer belt 7 therebetween.

Separation Configuration

Next, a separation mechanism of the intermediate transfer belt 7 will be described with reference to FIGS. 5 to 10C. The image forming apparatus 100 of the present embodiment includes a separation mechanism 300 that separates the intermediate transfer belt 7 from the photosensitive drums 1. The separation mechanism 300 is switchable among a full-contact mode (CL mode), a partial separation mode (Bk mode), and a full-separation mode. The full-contact mode is a mode in which the intermediate transfer belt 7 is brought into contact with all the photosensitive drums 1 serving as first or second image bearing members, and is executed when forming a full-color image. The partial separation mode is a mode in which the intermediate transfer belt 7 is brought into contact with the photosensitive drum 1 of Bk serving as a first image bearing member and is separated from the other photosensitive drums 1 serving as second image bearing members, and is executed when forming a black and white image. The full-separation mode is a mode in which the intermediate transfer belt 7 is separated from all the photosensitive drums 1. Detailed description will be given below.

Figure 5:
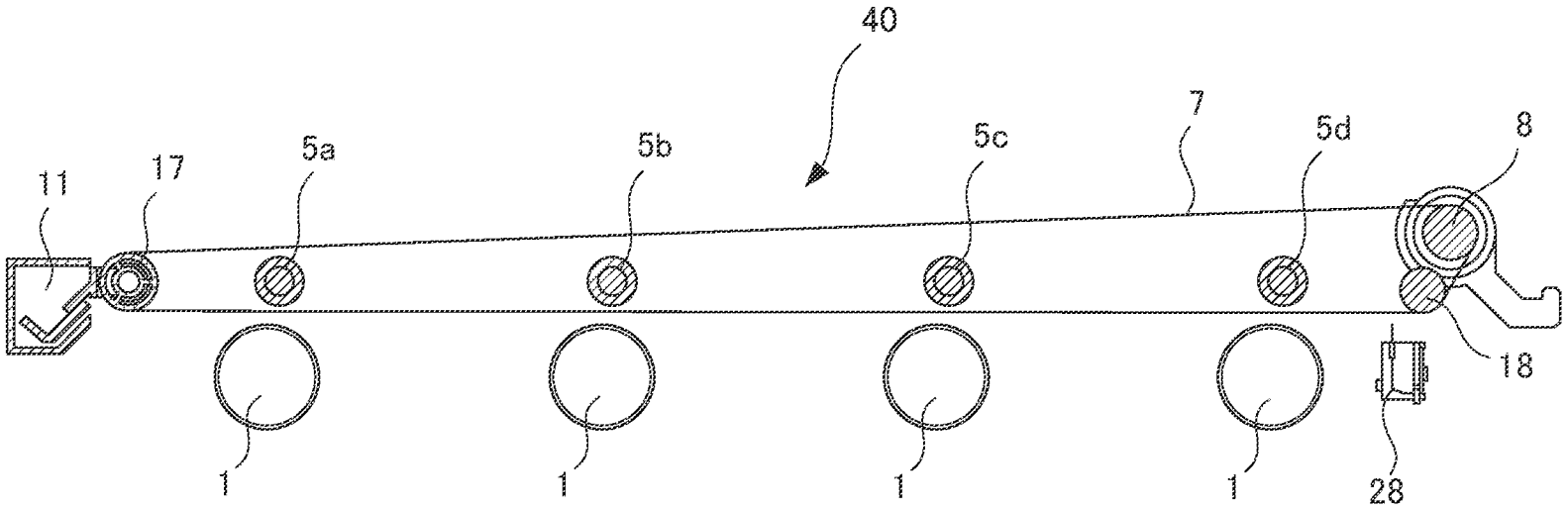
FIG. 5 is a schematic section view of a belt unit according to the embodiment in a separation state illustrating a configuration thereof.

The primary transfer rollers 5 are configured to be movable in a direction away from the photosensitive drums 1 as illustrated in FIG. 5 when outputting a Bk monochromatic image, that is, a black and white image or when attaching or detaching the belt unit 40. In addition, in the full-separation mode, the driven roller 18 positioned between the Bk photosensitive drum 1 and the driving roller 8 in the rotation direction of the intermediate transfer belt 7 simultaneously moves in the direction away from the photosensitive drums 1. Such a separation mechanism is employed for elongating the lifetime of the primary transfer rollers 5 and suppressing generation of scratches on the intermediate transfer belt 7 in attachment or detachment of the belt unit 40.

Figure 6:
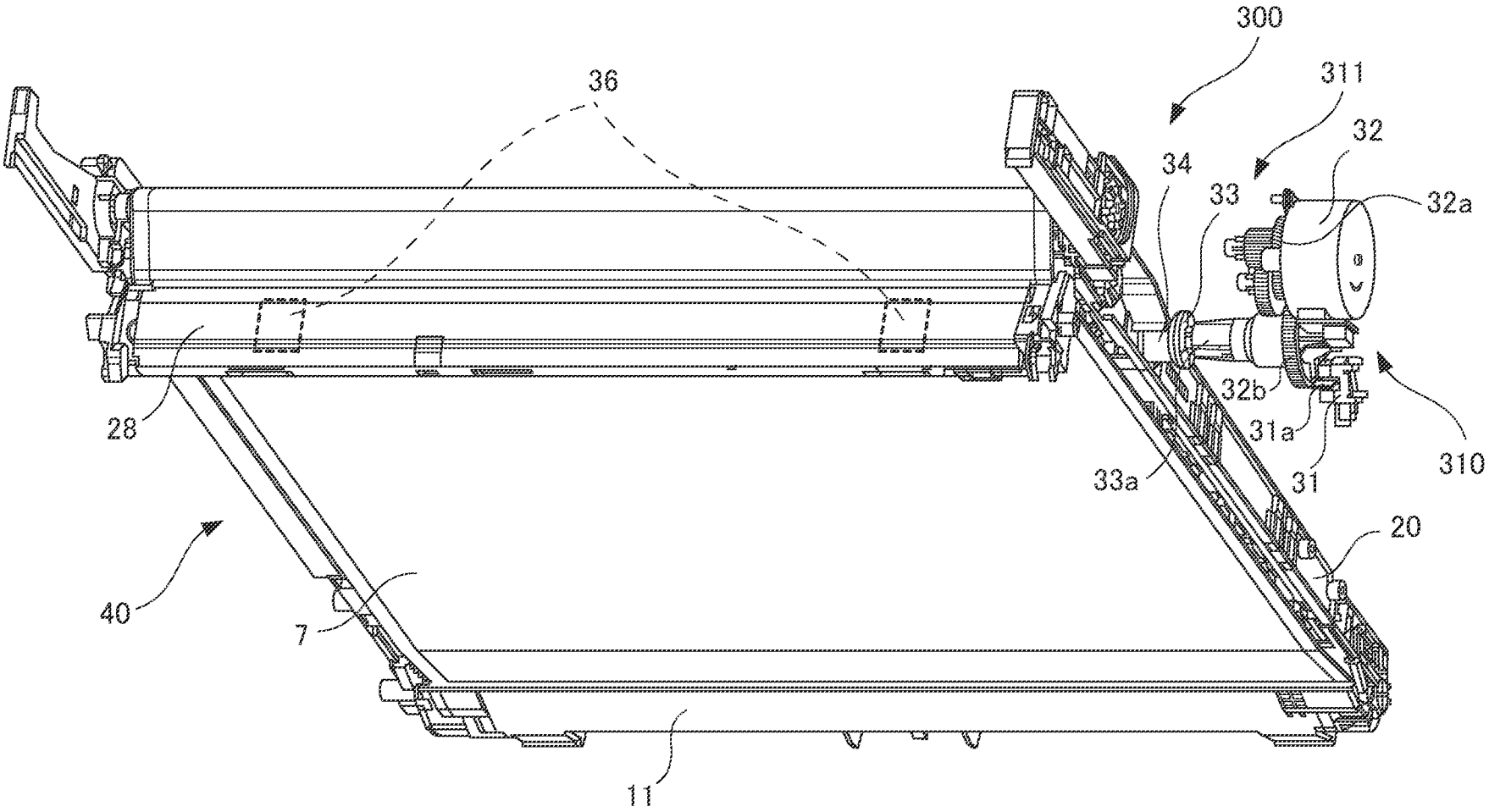
FIG. 6 is a perspective view of the belt unit including a driving element of a separation mechanism according to the embodiment.

As illustrated in FIG. 6, the separation mechanism 300 is driven by a main driving unit 310. The main driving unit 310 serving as a driving unit includes a driving motor 32 serving as a drive source, a drive transmission portion 311 that transmits the drive of the driving motor 32 to a belt-side coupling 34, and so forth. The drive transmission portion 311 includes a gear train 32*a* coupled to a drive shaft of the driving motor 32, a gear 32*b* coupled to the gear train 32*a*, a motor-side coupling 33, and a transmission shaft 33*a* coupling the gear 32*b* and the motor-side coupling 33 to each other. The motor-side coupling 33 is coupled to the belt-side coupling 34. As a result of this, the rotation of the driving motor 32 is transmitted to the gear train 32*a*, the gear 32*b*, the transmission shaft 33*a*, the motor-side coupling 33, and the belt-side coupling 34 in this order.

The gear 32*b* serving as a driving member disposed to be coaxial to the motor-side coupling 33 via the transmission shaft 33*a* is provided with a flag 31*a*. To be noted, any member constituting the drive transmission portion 311 may serve as the driving member, and in the present embodiment, the gear 32*b* provided with the flag 31*a* is used as the driving member as will be described next.

A photo-interrupter 31 that is a photosensor serving as a first detection portion and a phase detection portion is fixed to the driving motor 32 at a position below the driving motor 32 and opposing the gear 32*b*. The photo-interrupter 31 includes a light emitting portion and a light receiving portion that oppose each other, and the flag 31*a* provided on the gear 32*b* is capable of passing through a gap between the light emitting portion and the light receiving portion of the photo-interrupter 31. That is, the flag 31*a* provided on the gear 32*b* also rotates when the gear 32*b* is rotated by the rotation of the driving motor 32. As a result of this, the flag 31*a* passes through the gap between the light emitting portion and the light receiving portion of the photo-interrupter 31. The photo-interrupter 31 detects the home position of a cam 27 illustrated in FIG. 7 and so forth and described later by detecting the flag 31*a*. That is, the photo-interrupter 31 detects the operation of the separation mechanism 300 from the state of the gear 32*b* provided with the flag 31*a*, that is, the rotational position of the gear 32*b* and whether or not the gear 32*b* is rotating.

Figure 7:
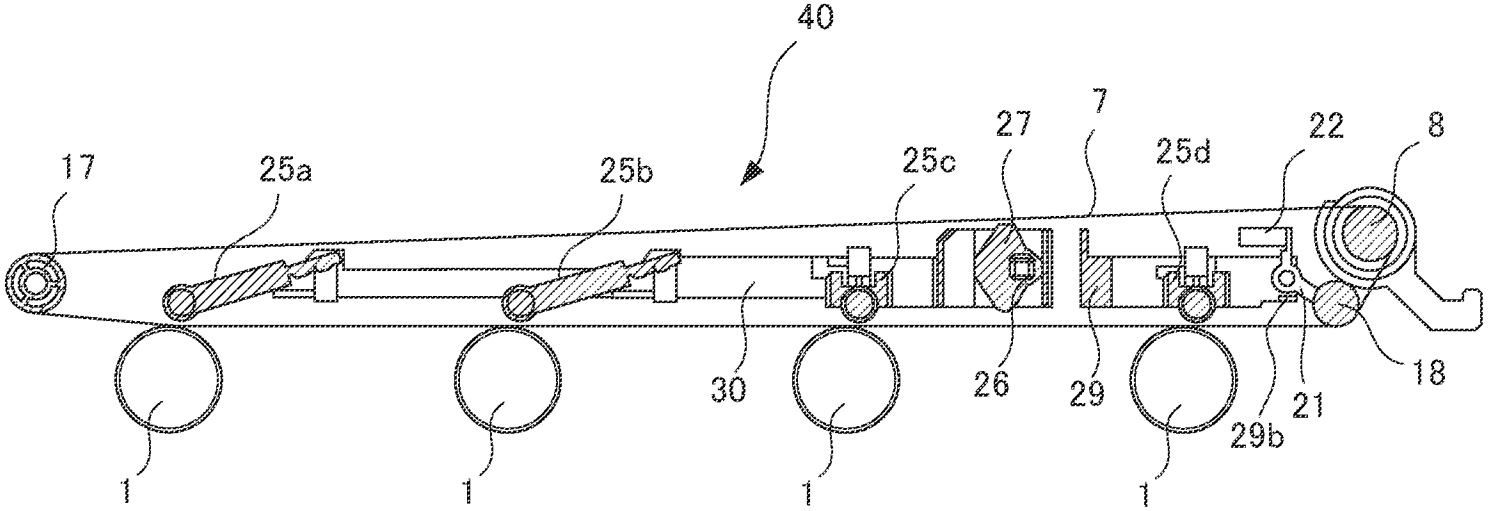
FIG. 7 is a section view of the belt unit including the separation mechanism according to the embodiment.
Figure 8:
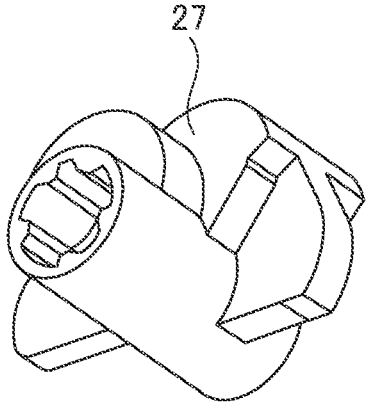
FIG. 8 is a perspective view of a cam of the separation mechanism according to the embodiment.

As illustrated in FIG. 7, the belt-side coupling 34 is attached to a shaft 26 that is rotatably supported parallel to each roller by the intermediate transfer frame 20, and inputs a drive. The cam 27 of a shape illustrated in FIG. 8 is fixed to each end of the shaft 26 on the inner side of the intermediate transfer frame 20. Therefore, the cams 27 rotates when the drive of the driving motor 32 is input to the shaft 26 through the belt-side coupling 34.

A Bk slider 29 and a CL slider 30 are disposed in the intermediate transfer frame 20 so as to engage with the cams 27, and when the cams 27 rotate, the Bk slider 29 and the CL slider 30 each move in the left-right direction in FIG. 7. As described with reference to FIG. 4 and the like, the protrusion portions 25*e* to 25*h* are provided on the primary transfer holders 25*a* to 25*d*.

Figure 9A:
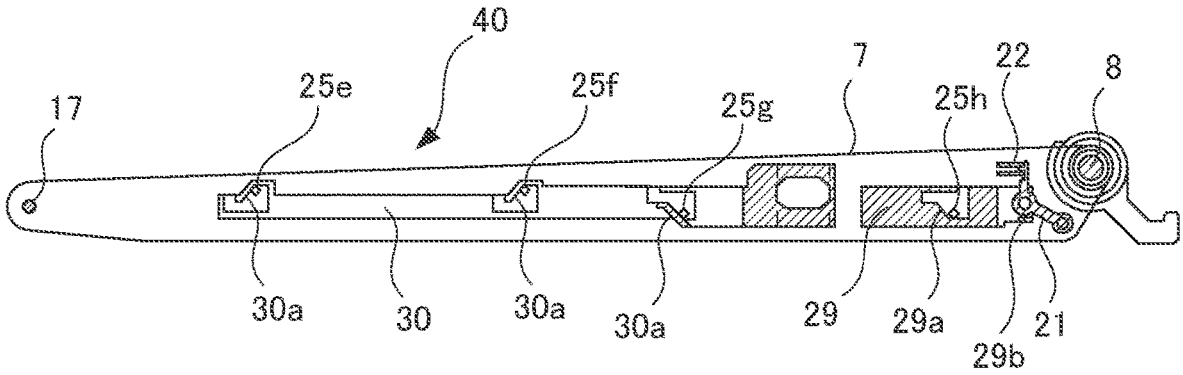
FIG. 9A is a schematic view of the belt unit illustrating a state in which an intermediate transfer belt is in contact with all photosensitive drums.
Figure 9B:
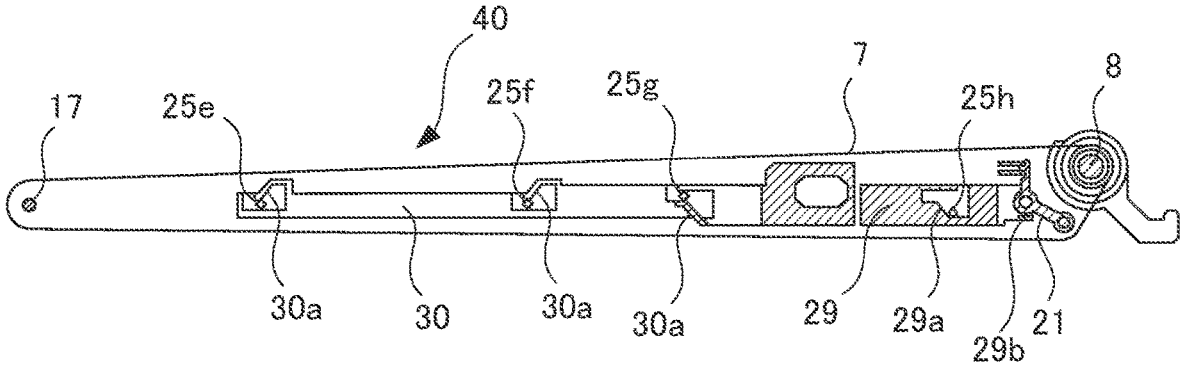
FIG. 9B is a schematic view of the belt unit illustrating a state in which the intermediate transfer belt is in contact with only a black photosensitive drum.
Figure 9C:
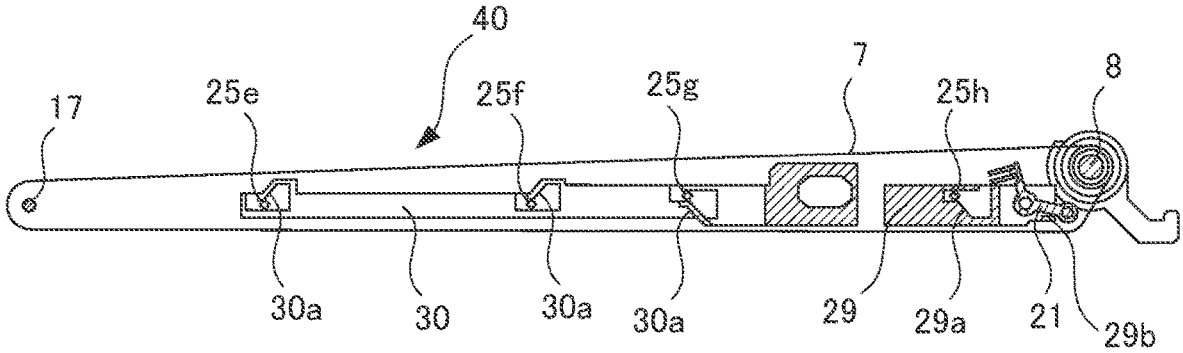
FIG. 9C is a schematic view of the belt unit illustrating a state in which the intermediate transfer belt is separated from all the photosensitive drums.

As illustrated in FIGS. 9A to 9C, the protrusion portions 25*e* to 25*h* are disposed so as to engage with inclined surface portions 29*a* and 30*a* respectively provided in the Bk slider 29 and the CL slider 30. The inclined surface portion 29*a* is provided in the Bk slider 29, and engages with the protrusion portion 25*h* provided on the primary transfer holder 25*d*. Three inclined surface portions 30*a* are provided in the CL slider 30, and respectively engage with the protrusion portion 25*e* of the primary transfer holder 25*a*, the protrusion portion 25*f* of the primary transfer holder 25*b*, and the protrusion portion 25*g* of the primary transfer holder 25*c* in this order from the left side in FIG. 9A.

The protrusion portions 25*e* to 25*h* are guided while sliding on the inclined surface portions 29*a* and 30*a* by moving the Bk slider 29 and the CL slider 30 in the left-right direction of FIGS. 9A to 9C. As a result of this, the primary transfer holders 25*a* and 25*b* pivot, and the primary transfer holders 25*c* and 25*d* translationally move. Thus, the primary transfer rollers 5*a* to 5*d* move the intermediate transfer belt 7 in a contact/separation direction with respect to the photosensitive drums 1.

As described above, the driven roller 18 is rotatably supported by the driven roller bearings 21 pivotably supported by the intermediate transfer frame 20. When the Bk slider 29 moves, push-up portions 29*b* of the Bk slider 29 push up the driven roller bearings 21 in a direction opposite to the intermediate transfer belt 7, and thus the driven roller 18 is separated. To be noted, the driven roller bearings 21 are urged by the springs 22, and push down the intermediate transfer belt 7 when the Bk slider 29 moves in a direction opposite to the direction described above and the push-up portions 29*b* retract from the driven roller bearings 21. The separation mechanism 300 is an element beyond the belt-side coupling 34, and is a mechanism that includes the cams 27, the Bk slider 29, the CL slider 30, and so forth, and switches the intermediate transfer belt 7 among the three modes described above.

The separation operation can be switched among the three modes described above in accordance with the rotational position where the cams 27 are stopped. FIGS. 9A to 9C illustrate the three modes. FIG. 9A illustrates the CL mode in which all the primary transfer rollers 5 are pressed against the photosensitive drums 1. FIG. 9B illustrates the Bk mode in which only the Bk primary transfer roller 5*d* is pressed against the photosensitive drum 1. FIG. 9C illustrates the full-separation mode in which all the primary transfer rollers 5 have moved away from the photosensitive drums 1. The rotation of the cams 27 is controlled by setting a state in which the photo-interrupter 31 functioning as a home position sensor is ON as the Bk mode serving as a reference.

Figure 10A:
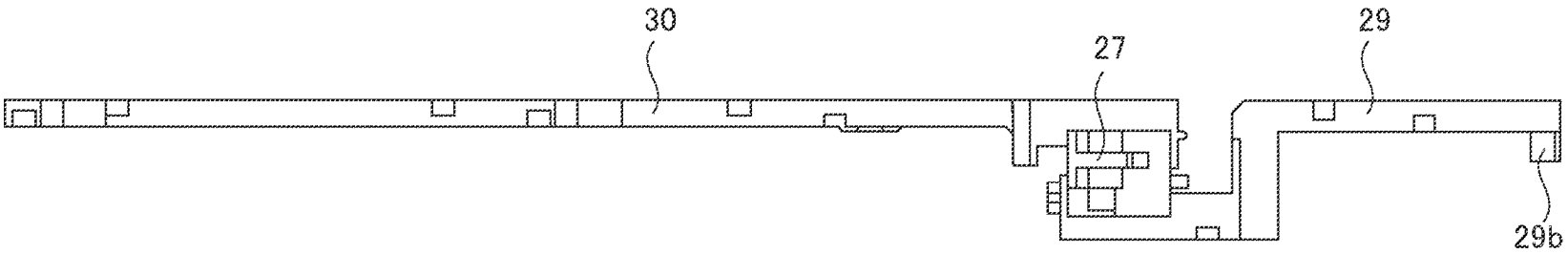
FIG. 10A is a plan view of a separation mechanism illustrating a state in which the intermediate transfer belt is in contact with all the photosensitive drums.
Figure 10B:
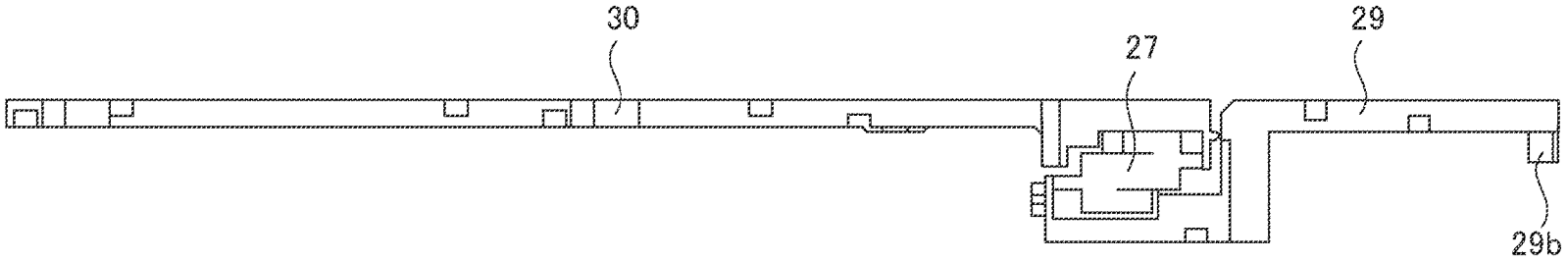
FIG. 10B is a plan view of the separation mechanism illustrating a state in which the intermediate transfer belt is in contact with only a black photosensitive drum.
Figure 10C:
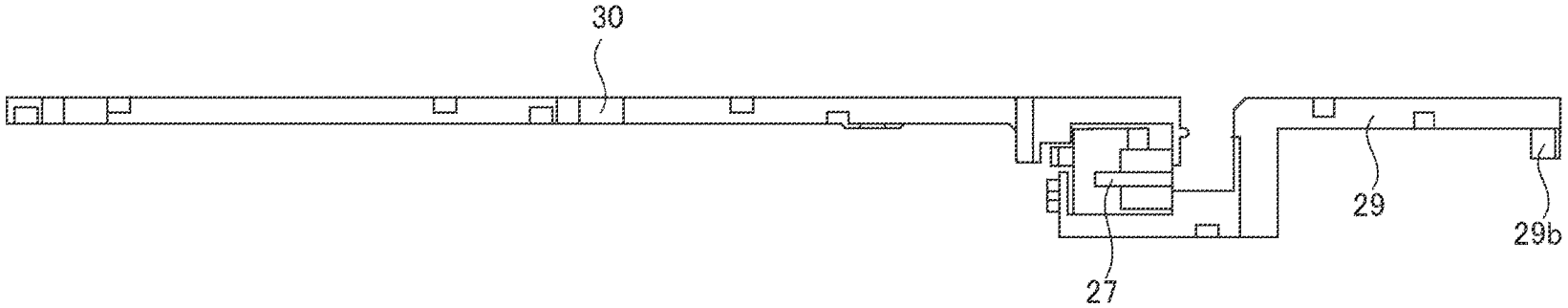
FIG. 10C is a plan view of the separation mechanism illustrating a state in which the intermediate transfer belt is separated from all the photosensitive drums.

FIGS. 10 A to 10C illustrate the positional relationship between the cams 27, the Bk slider 29, and the CL slider 30 in the three modes described above. The cams 27 each have a cam surface for the Bk slider 29 and a cam surface for the CL slider, and the cams 27 are configured such that every 120° rotation thereof corresponds to different movements of the Bk slider 29 and the CL slider 30. FIGS. 9A to 9C and 10A to 10C respectively correspond to rotation angles of the cams 27 with 120° difference. FIGS. 9A and 10A illustrate a state in which the Bk slider 29 is positioned on the left and the CL slider 30 is also positioned on the left. FIGS. 9B and 10B illustrate a state in which the Bk slider 29 is positioned on the right and the CL slider 30 is positioned on the left. FIGS. 9C and 10C illustrate a state in which the Bk slider 29 is positioned on the right and the CL slider 30 is also positioned on the right. The separation of the intermediate transfer belt 7 is performed by a combination of this movement direction, the shapes of the inclined surface portions 29*a* and 30*a* of the Bk slider 29 and the CL slider 30, and the shape of the push-up portions 29*b* of the Bk slider 29.

Patch Sensor Unit

Next, the patch sensor unit 28 will be described. FIG. 6 illustrates the positional relationship between the belt unit 40 and the patch sensor unit 28. The patch sensor unit 28 is disposed to approximately oppose the driven roller 18 with the intermediate transfer belt 7 therebetween, and is positioned at a desired distance from the intermediate transfer belt 7 by pressing the end portions thereof against the driven roller bearings 21 supporting the driven roller 18. Two reflective sensors 36 serving as second detection portions and optical sensors each constituted by a light emitting element serving as a light emitting portion and a light receiving element serving as a light receiving portion are disposed in the patch sensor unit 28 so as to oppose the surface of the intermediate transfer belt 7. The reflective sensors 36 each include a light emitting element that emits light toward the intermediate transfer belt 7, and a light receiving element that receives light reflected by the intermediate transfer belt 7. As described above, the position of the driven roller 18 differs between the CL mode and the full-separation mode. Therefore, the reflective sensors 36 are disposed at positions whose distance from the intermediate transfer belt 7 changes in accordance with the separation operation of the intermediate transfer belt 7 from the photosensitive drums 1.

In the image forming apparatus 100 of the present embodiment, a patch image serving as a control toner image constituted by a predetermined pattern for detecting the toner density and position or color deviation is formed on the intermediate transfer belt 7 by each image forming portion 10 at a predetermined timing that is set in advance. The patch image that is a toner patch pattern for detection is formed in a similar process to a toner image that is formed in normal image formation. The reflective sensors 36 are capable of detecting the patch image on the intermediate transfer belt 7. A controller of the image forming apparatus 100 detects the patch image on the intermediate transfer belt 7 by the reflective sensors 36, and performs, on the basis of the obtained detection information, control for correcting the density, formation timing, and the like of toner images formed by the image forming portions 10.

Automatic Malfunction Diagnosis

As described above the separation of the intermediate transfer belt 7, that is, primary transfer separation is performed for elongating the lifetime and suppressing scratches on the belt, and therefore not only image defects but also decrease in the lifetime and breakage of units can be caused if the separation is not appropriately performed. Therefore, in the case where an abnormality has occurred in the separation operation of the intermediate transfer belt 7, control for displaying an error message and stopping the apparatus is performed. The separation operation will be hereinafter also referred to as a primary transfer separation operation. In the present embodiment, the CPU 301 serving as an output portion or a determination portion illustrated in FIG. 13 that will be described later determines that an error has occurred in the operation of the separation mechanism 300 in the case where the signal of the photo-interrupter 31 is not switched until the elapse of a predetermined time or more since outputting a drive start signal serving as a driving signal to the driving motor 32. Further, the CPU 301 is capable of outputting a signal indicating this. The CPU 301 displays a screen related to an operation error of the separation mechanism 300 on an operation panel 102 illustrated in FIG. 13 serving as an operation portion and a display portion included in the image forming apparatus 100, or a monitor of a personal computer (PC) connected to the image forming apparatus 100.

Specifically, the CPU 301 issues a "primary transfer separation operation error", which is a signal for notifying an abnormality related to the operation of the separation mechanism 300, in the case where the signal of the photo-interrupter 31 is not switched from ON to OFF or OFF to ON until the elapse of 2 seconds serving as a predetermined time since outputting a drive start signal, that is, a motor ON signal to the driving motor 32. In addition, in the present embodiment, an automatic malfunction diagnosis mode serving as an abnormality diagnosis mode is provided for specifying the location of the malfunction for quick restoration when the error screen is displayed. How the automatic malfunction diagnosis is performed by using the patch sensor unit 28 and the primary transfer separation operation will be described below.

Figure 11A:
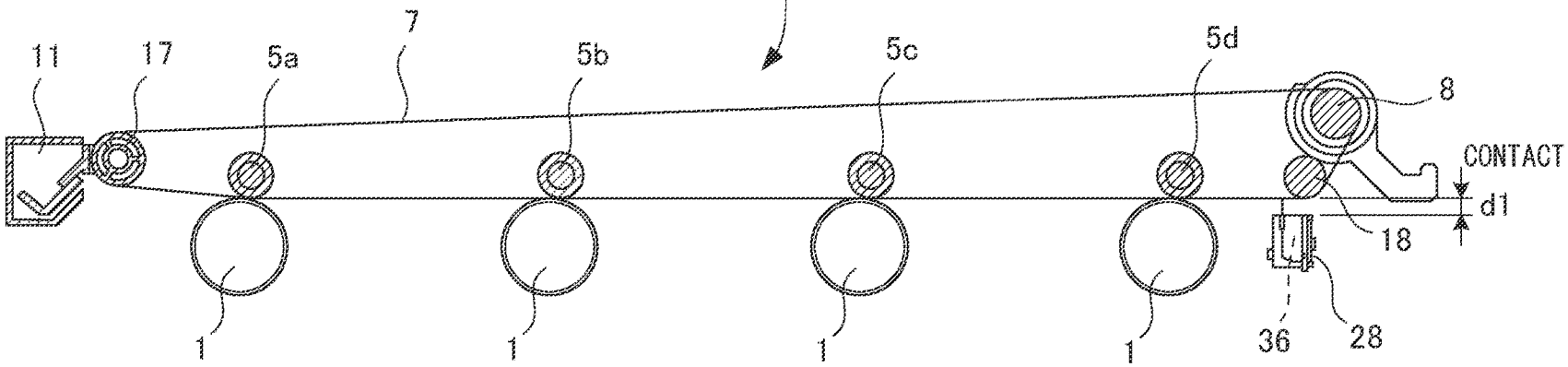
FIG. 11A is a schematic view of the belt unit and a patch sensor unit illustrating a state in which the intermediate transfer belt is in contact with all the photosensitive drums.
Figure 11B:
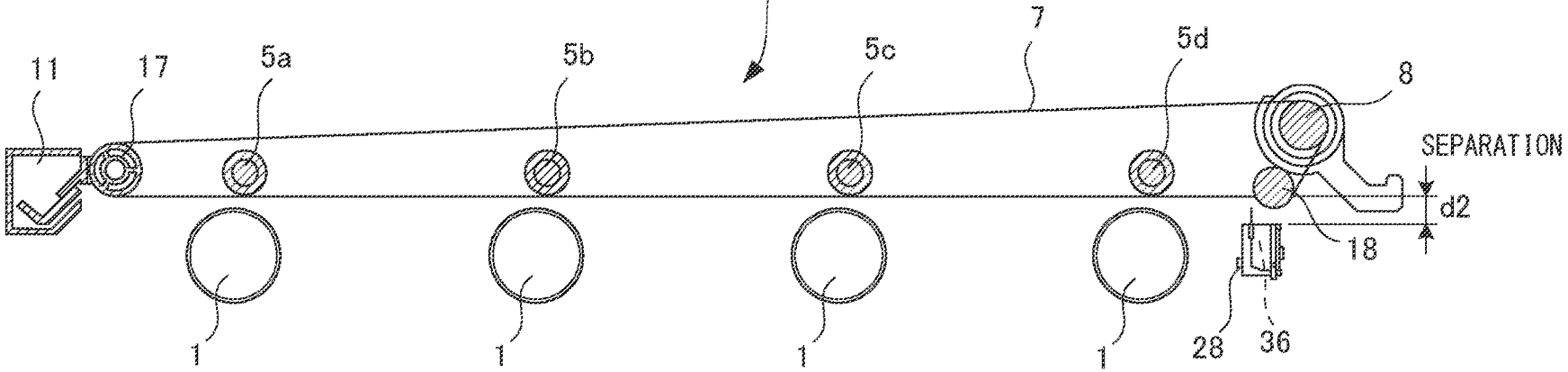
FIG. 11B is a schematic view of the belt unit and the patch sensor unit illustrating a state in which the intermediate transfer belt is separated from all the photosensitive drums.

FIGS. 11A and 11B are respectively section views of the belt unit 40 in the CL mode and the full-separation mode. When the primary transfer separation operation is performed by the driving motor 32, the intermediate transfer belt surface in contact with the primary transfer rollers 5 and the driven roller 18 moves away from the photosensitive drums 1. The patch sensor unit 28 is positioned by abutting the driven roller bearings 21 as described above. To be noted, the pressurizing movable range of the patch sensor unit 28 is set to be narrower than the distance by which the driven roller 18 moves in the primary transfer separation operation. According to such settings, the clearance between the intermediate transfer belt 7 and the reflective sensors 36 of the patch sensor unit 28 is larger in the full-separation mode illustrated in FIG. 11B than in the CL mode illustrated in FIG. 11A. The clearance is d1 in the CL mode, and d2 in the full-separation mode. The automatic malfunction diagnosis is performed by using the difference between the clearances d1 and d2. That is, the CPU 301 outputs the driving signal so as to be switched to both the CL mode and the full-separation mode in the automatic malfunction diagnosis mode.

Figure 12:
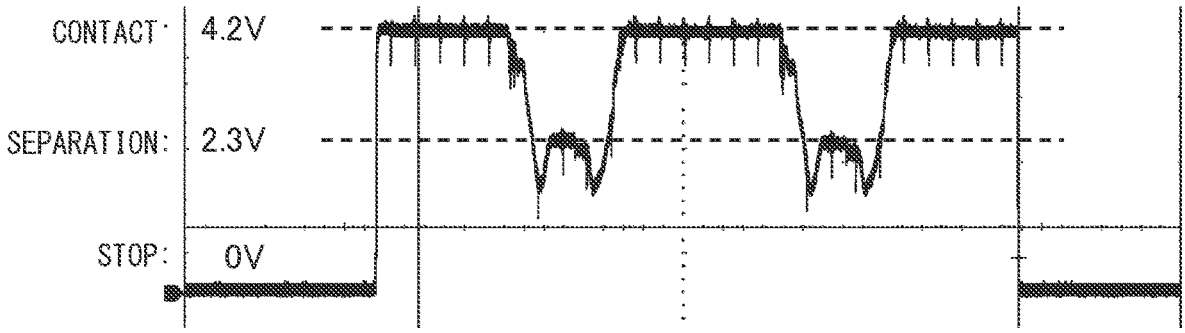
FIG. 12 is a graph illustrating a signal of reflective sensors according to the embodiment.

FIG. 12 is a graph of an output signal of the reflective sensors 36 included in the patch sensor unit 28 when the primary transfer separation operation is performed. The horizontal axis represents time, and the vertical axis represents voltage. FIG. 12 illustrates a waveform in the case where the contact/separation operation of the intermediate transfer belt 7, that is, switch between the CL mode and the full-separation mode is performed twice. Assuming that the voltage is 0 V when the sensors are off, it can be seen that the voltage changes to 4.2 V in the CL mode, that is, in the contact state, and to 2.3 V in the full-separation mode, that is, in the separation state. Whether the primary transfer separation operation is performed can be determined from the difference between these.

Figure 13:
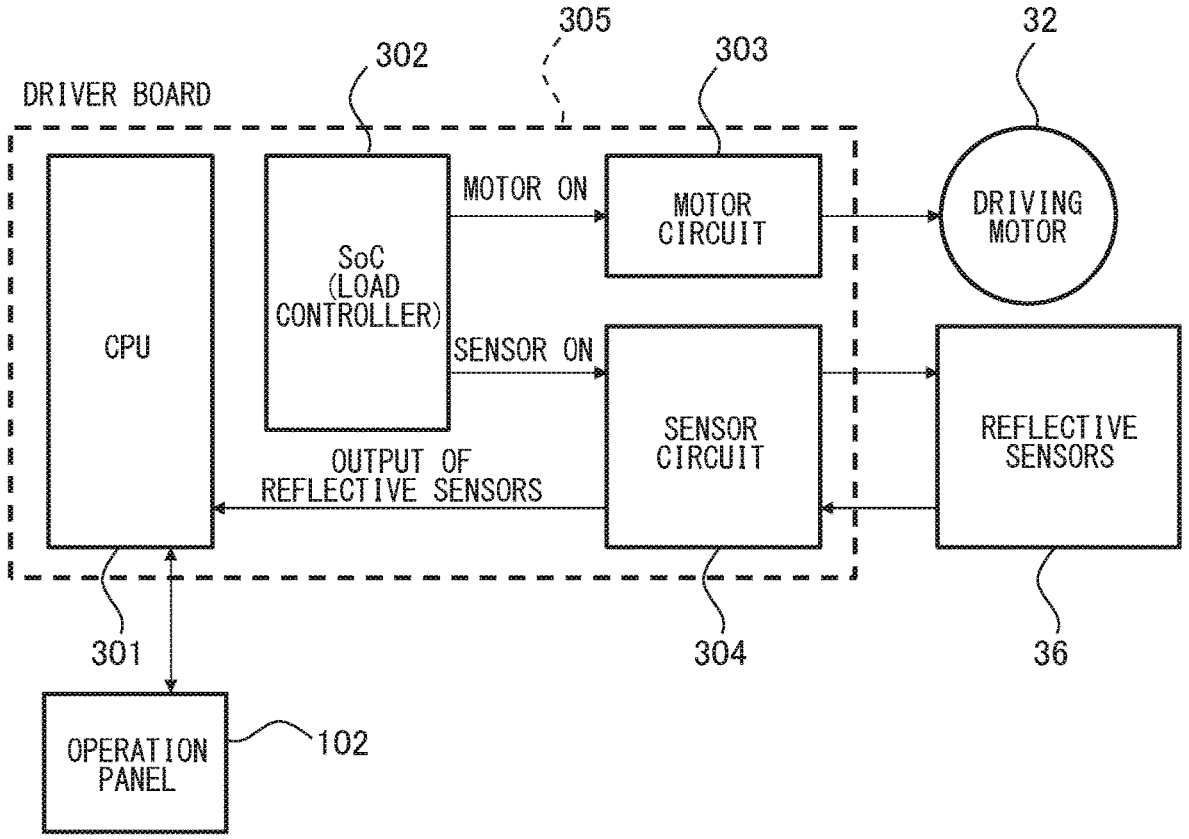
FIG. 13 is a control block diagram related to control of the separation mechanism according to the embodiment.

A driver board 305 serving as a controller of the image forming apparatus 100 of the present embodiment will be described with reference to FIG. 13. FIG. 13 is a configuration block diagram of units that the driver board 305 controls. An ON/OFF signal of the driving motor 32 is output from a system on a chip (SoC) 302 serving as a load controller, and the driving motor 32 is controlled via a motor circuit 303. In addition, an ON/OFF signal of the reflective sensors 36 is output from the SoC 302, and the reflective sensors 36 are controlled via a sensor circuit 304. As will be described later, the output of the reflective sensors 36 is transmitted to the CPU 301 through the sensor circuit 304, and is computed to be used as a determination criterion for malfunction diagnosis as will be described later.

Figure 14:
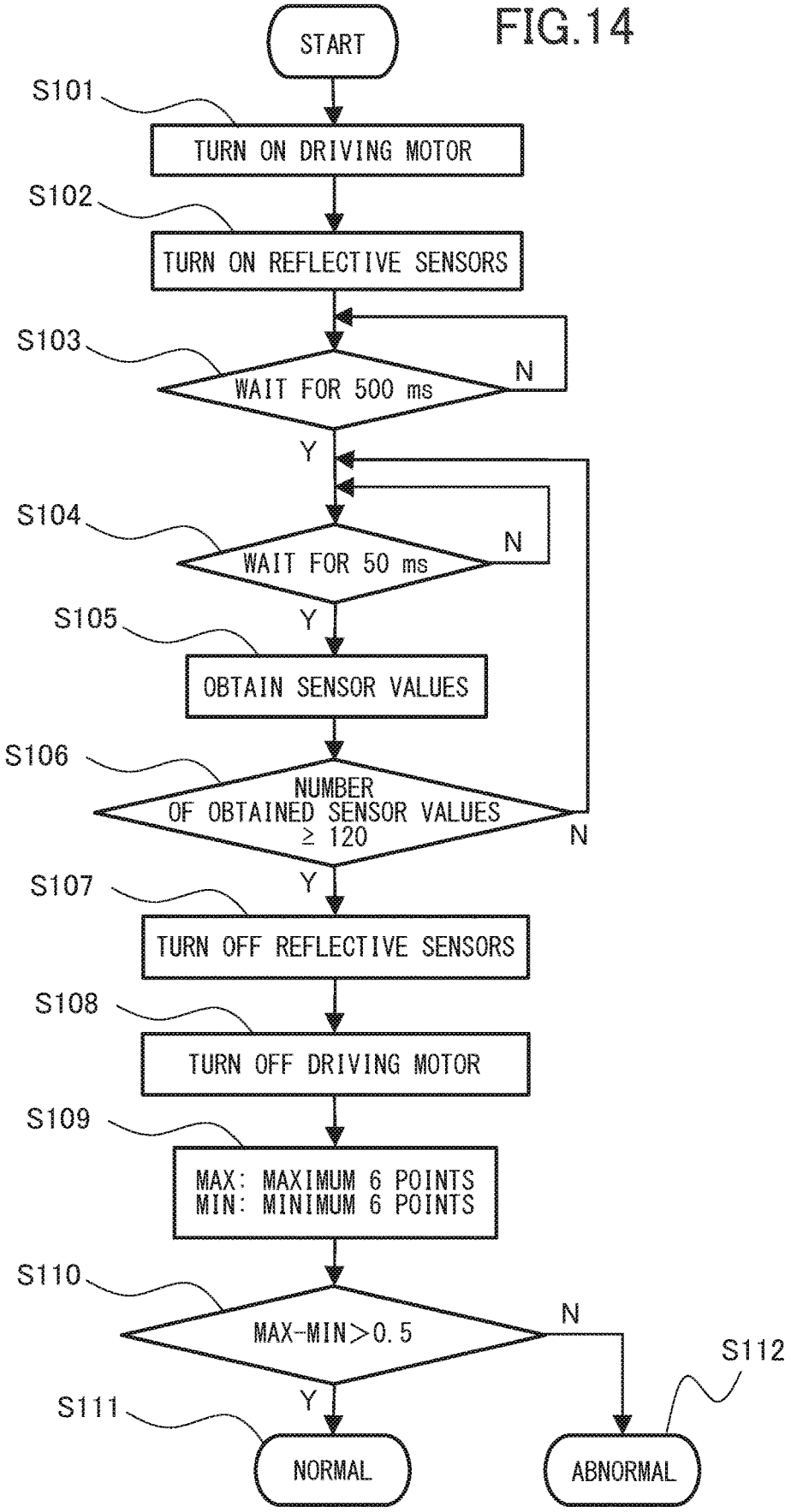
FIG. 14 is a flowchart illustrating an example of malfunction diagnosis control of the separation mechanism according to the embodiment.

FIG. 14 is a flowchart illustrating an example of malfunction diagnosis control. As described above, the CPU 301 issues the "primary transfer separation operation error" in the case where the signal of the photo-interrupter 31 is not switched from ON to OFF or from OFF to ON even after the elapse of 2 seconds since outputting a driving command to the driving motor 32 to perform the primary transfer separation operation. In the case where the primary transfer separation operation error has occurred, the CPU 301 turns the driving motor 32 and the reflective sensors 36 on in steps S101 and S102, and stands by for 500 ms for stabilizing the operation in step S103. That is, in the case where change in the phase of the cams 27 is not detected by the photo-interrupter 31 until the elapse of a predetermined time or more since the start of output of the driving signal for driving the separation mechanism 300, the CPU 301 outputs the primary transfer separation operation error, and after notifying the primary transfer separation operation error, executes the automatic malfunction diagnosis mode. Specifically, the CPU 301 drives the driving motor 32 in the case where it has been determined that an error has occurred in the operation of the separation mechanism 300, that is, the primary transfer separation operation error has occurred, on the basis of the detection results of the photo-interrupter 31.

Then, the CPU 301 starts obtaining the output of the reflective sensors 36 every 50 ms in steps S104 and S105. That is, the sampling of the sensor values or signal values of the reflective sensors 36 is performed every 50 ms. In addition, the sampling is performed 120 times or more in step S106. Then, the reflective sensors 36 and the driving motor 32 are turned off in steps S107 and S108, and the sampled sensor values are transmitted to the CPU 301 and computed.

Here, the maximum 6 points and minimum 6 points of the sampled values are obtained in step S109, and it is determined in step S110 whether the difference between the average of the maximum 6 points and the average of the minimum 6 points obtained by subtraction, that is, the amount of change in the signal value is larger than 0.5 serving as a predetermined amount. It is determined in step S111 that the operation is normal in the case where the difference is larger than 0.5, and it is determined in step S112 that the operation is abnormal in the case where the difference is equal to or smaller than 0.5.

That is, the CPU 301 determines that the operation of the separation mechanism 300 is performed normally, in the case where the amount of change in the signal value of the reflective sensors 36 serving as a detection result is larger than a predetermined amount while the driving motor 32 is driven. In this case, it can be determined that the photo-interrupter 31 or the flag 31*a* is malfunctioning. In contrast, in the case where the amount of change in the signal value of the reflective sensors 36 while the driving motor 32 is driven is equal to or smaller than the predetermined value, the CPU 301 determines that an abnormality has occurred in the operation of the separation mechanism 300. In this case, it can be considered that there is a problem in the drive path from the driving motor 32 to the separation mechanism 300, and therefore it is determined that an abnormality has occurred in the main driving unit 310 including the drive transmission portion 311 and/or in the separation mechanism 300. That is, in the automatic malfunction diagnosis mode, the CPU 301 can output information about an abnormality in the photo-interrupter 31 and information about an abnormality in the separation mechanism 300 and/or the main driving unit 310 on the basis of a detection result of the reflective sensors 36 in the case of outputting a driving signal for driving the separation mechanism 300 and emitting light from the reflective sensors 36 while the driving signal is output.

To be noted, the threshold value used herein is a mere example, and the threshold value is changed if the unit configuration is changed. In addition, the calculation method described above is not limited to this, and the detection can be also performed by comparing waveforms of the output signal, comparing ON/OFF periods, or the like. In short, any method can be employed as long as whether the intermediate transfer belt 7 is in contact with or out of contact with the photosensitive drums 1 can be determined from the amount of change in the signal value of the reflective sensors 36.

Figure 15:
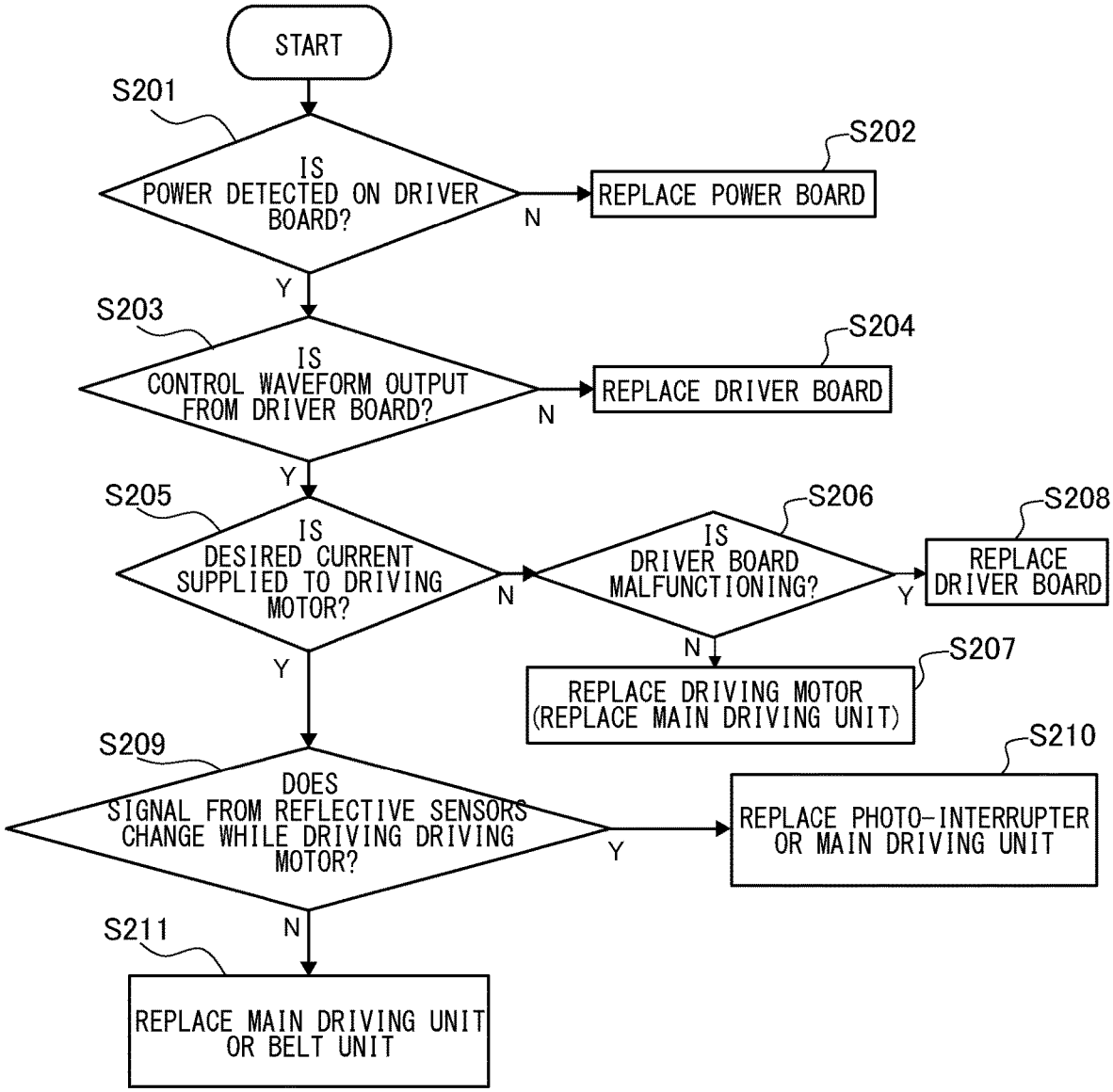
FIG. 15 is a flowchart illustrating an example of malfunction location determination according to the embodiment.

Details of the malfunction location determination will be described with reference to a flowchart of FIG. 15. First, in the case of the present embodiment, the driving motor 32 serving as a drive source is also a member constituting the main driving unit 310 illustrated in FIG. 6. In addition, the gear 32*b* serving as a driving member is also a member constituting the main driving unit 310. To be noted, the driving motor 32 is preferably configured to be attachable to and detachable from the apparatus body 100A separately from the drive transmission portion 311 and the like of the main driving unit 310.

In addition, the photo-interrupter 31 is fixed to the driving motor 32 of the main driving unit 310, and is attached to and detached from the apparatus body 100A together with the main driving unit 310. To be noted, the photo-interrupter 31 is also preferably configured to be attachable to and detachable from the apparatus body 100A separately from the main driving unit 310.

Here, an unillustrated power board for supplying power to each component of the apparatus, the driver board 305 illustrated in FIG. 13, the driving motor 32, the main driving unit 310, the photo-interrupter 31, and the belt unit 40 can be the cause of the primary transfer separation operation error. Therefore, in the present embodiment, these serve as diagnosis targets for the malfunction location determination.

As described above, when the primary transfer separation operation error has occurred, the CPU 301 outputs a drive start signal to the driving motor 32, and turns the reflective sensors 36 of the patch sensor unit 28 on. As a result of this, the diagnosis starts. Steps S201 to S208 of FIG. 15 correspond to electric diagnosis of the power board and the driving motor. First, in the case where power cannot be detected on the driver board 305, that is, in the case where the result of step S201 is N, the CPU 301 determines that the power source board is malfunctioning, and displays a screen prompting replacement of the power board on the operation panel 102 in step S202. To be noted, such a screen for replacement or warning may be alternatively output to, for example, a monitor of a PC connected thereto in place of the operation panel 102. This also applies to the following case.

Next, in the case where power has been detected on the driver board 305, that is, in the case where the result of step S201 is Y, the CPU 301 checks whether a control waveform is output from the driver board 305 to the driving motor 32 in step S203. In the case where the control waveform is not output from the driver board 305 to the driving motor 32, that is, in the case where the result of step S203 is N, the CPU 301 determines that the driver board 305 itself is malfunctioning, and displays a screen prompting replacement of the driver board 305 on the operation panel 102 in step S204.

Next, in the case where the control waveform is output from the driver board 305 to the driving motor 32, that is, in the case where the result of step S203 is Y, the CPU 301 checks whether a desired current is supplied to the driving motor 32 in step S205. In the case where the desired current is not supplied to the driving motor 32, that is, in the case where the result of step S205 is N, the CPU 301 determines whether or not the driver board 305 itself is malfunctioning, in step S206 by self diagnosis of the driver board 305. In the case where it has been determined that the driver board 305 is not malfunctioning, that is, in the case where the result of step S206 is N, the CPU 301 determines that the driving motor 32 is malfunctioning, and displays a screen prompting replacement of the driving motor 32 or the main driving unit 310 including the driving motor 32 on the operation panel 102 in step S207. To be noted, at this time, if the driving motor 32 is configured to be individually replaceable as described above, wasteful replacement of the whole main driving unit can be suppressed.

In contrast, in the case where it has been determined that the driver board 305 itself is malfunctioning in step S206, that is, in the case where the result of step S206 is Y, the CPU 301 displays a screen prompting replacement of the driver board 305 on the operation panel 102 in step S208.

In the case where a desired current is supplied to the driving motor 32 in step S205, that is, in the case where the result of step S205 is Y, the operation of the driving motor 32 is guaranteed, and the CPU 301 proceeds to step S209 and performs diagnosis control described with reference to FIG. 14. That is, the CPU 301 drives the driving motor 32, and checks the amount of change in the signal value of the reflective sensors 36, that is, the detection result while the driving motor 32 is driving. Then, the CPU 301 outputs information about an abnormality of the separation mechanism 300 or the photo-interrupter 31 on the basis of the detection result of the reflective sensors 36 during the driving of the driving motor 32. Detailed description will be given below.

In the case where the amount of change in the signal value of the reflective sensors 36 is larger than the predetermined amount, that is, in the case where the result of step S209 is Y, it can be determined that the operation of the separation mechanism 300 is performed normally, and there is no problem in the main driving unit 310 including the drive transmission portion 311. In this case, the CPU 301 determines that the photo-interrupter 31 or the flag 31*a* performing the home position detection is malfunctioning, and outputs a signal prompting replacement of the photo-interrupter 31 or the main driving unit 310 including the photo-interrupter 31 as information about an abnormality. That is, the CPU 301 displays a screen prompting replacement of the photo-interrupter 31 or the main driving unit 310 on the operation panel 102, that is, outputs information prompting replacement in step S210. To be noted, in the case where the flag 31*a* is not damaged, wasteful replacement of the whole main driving unit can be suppressed if the photo-interrupter 31 is configured to be individually replaceable.

In contrast, in the case where the amount of change in the signal value of the reflective sensors 36 while the driving motor 32 is driving is equal to or smaller than the predetermined amount in step S209, that is, in the case where the result of step S209 is N, it can be determined that the drive from the driving motor 32 is not transmitted. This case can be considered as a failure in the drive transmission portion 311 of the main driving unit 310 or a failure in an element of the separation mechanism 300 beyond the belt-side coupling 34 in the belt unit 40 described above. Therefore, the CPU 301 outputs a signal prompting replacement of the main driving unit 310 including the gear 32*b* serving as a driving member or the belt unit 40 including the separation mechanism 300 as information about an abnormality. That is, the CPU 301 displays a screen prompting replacement of the main driving unit 310 or the belt unit 40 on the operation panel 102, that is, outputs information prompting replacement in step S211.

In this case, for example, an operator such as a user takes out the belt unit 40 and manually rotates the belt-side coupling 34. If the belt-side coupling 34 operates without a problem, the user can confirm that no abnormality has occurred in the belt unit 40, and determines that the main driving unit 310 is malfunctioning. In the case where the main driving unit 310 is malfunctioning, if the driving motor 32 is configured to be individually replaceable, only the parts other than the driving motor 32 in the main driving unit 310 such as the drive transmission portion 311 can be replaced, and the driving motor 32 that is not malfunctioning can be used efficiently.

To be noted, if the belt-side coupling 34 is manually rotated and operates abnormally, it is determined that the belt unit 40 is malfunctioning. In this case, since whether or not there is an abnormality in the mechanism of the main driving unit 310 cannot be determined, both the belt unit 40 and the main driving unit 310 are replaced. Alternatively, a configuration in which, after replacing the belt unit 40, the driving motor 32 is driven and the main driving unit 310 is replaced in the case where the amount of change in the signal value of the reflective sensors 36 in step S209 is equal to or smaller than the predetermined amount, that is, in the case where the result of step S209 is N, may be employed.

As described above, according to the present embodiment, where a malfunction has occurred can be determined without additionally providing a new sensor in the case where a separation error of the intermediate transfer belt 7 has occurred. That is, when the primary transfer separation error has occurred, by driving the driving motor 32 and reading the signal of the reflective sensors 36 at this time, which part is malfunctioning can be determined. Therefore, reliable malfunction diagnosis can be performed without additionally providing a new sensor, and the time for restoring the apparatus can be reduced greatly.

In the present embodiment, an example in which a first abnormality and a second abnormality can be notified on the basis of a detection result of the reflective sensors 36 during driving of the driving motor 32 has been described. That is, the first abnormality is an abnormality in the photo-interrupter 31 or the main driving unit 310 including the photo-interrupter 31. The second abnormality is an abnormality in the main driving unit 310 including the gear 32*b* serving as a driving member or the belt unit 40 including the separation mechanism 300. However, the configuration is not limited to this, and a configuration in which a third abnormality is notified on the basis of the detection result of the reflective sensors 36 during driving of the driving motor 32 may be employed.

Other Embodiments

The image forming apparatus of the present embodiment is not limited to a full-color printer, and may be a monochromatic printer. Alternatively, the present invention may be applied to various uses such as printers, various printing apparatuses, copiers, facsimile machines, and multifunctional apparatuses. In the case of a monochromatic image forming apparatus, for example, only one photosensitive drum serving as an image bearing member is provided. In addition, although an example in which the second detection portion is a reflective sensor has been described in the embodiment described above, the second detection portion may be a different sensor such as an image sensor.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-013604, filed Jan. 29, 2021, which is hereby incorporated by reference herein in its entirety.

What is claimed is:

1. An image forming apparatus comprising:

an image bearing member configured to bear a toner image;

an intermediate transfer belt configured to bear the toner image transferred from the image bearing member;

a separation mechanism configured to separate the intermediate transfer belt from the image bearing member;

a driving unit configured to drive the separation mechanism;

a cam configured to be driven by the driving unit to operate the separation mechanism;

a phase detection portion configured to detect a phase of the cam;

an optical sensor configured to irradiate a control toner image formed on the intermediate transfer belt with light and detect reflection light of the light, the optical sensor being configured such that a distance between the optical sensor and the intermediate transfer belt changes in accordance with an operation of the separation mechanism; and a controller configured to execute an abnormality diagnosis mode in a case where change in the phase of the cam is not detected by the phase detection portion until an elapse of a predetermined time or more since a start of output of a driving signal for driving the separation mechanism, wherein, in execution of the abnormality diagnosis mode, the controller outputs the driving signal for driving the separation mechanism, and is capable of outputting information about an abnormality of the phase detection portion and information about an abnormality of the separation mechanism and/or the driving unit on a basis of a detection result of the optical sensor that is obtained in a case where the light is radiated from the optical sensor while the driving signal is output.

2. The image forming apparatus according to claim 1, wherein, in the execution of the abnormality diagnosis mode, the controller outputs a signal for notifying that an abnormality has occurred in the phase detection portion in a case where an amount of change in the detection result of the optical sensor is greater than a predetermined amount.

3. The image forming apparatus according to claim 1, wherein, in the execution of the abnormality diagnosis mode, the controller outputs a signal for notifying that an abnormality has occurred in the separation mechanism and/or the driving unit in a case where an amount of change in the detection result of the optical sensor is greater than a predetermined amount.

4. The image forming apparatus according to claim 1, wherein, in the case where change in the phase of the cam is not detected by the phase detection portion until an elapse of the predetermined time or more since the start of the output of the driving signal for driving the separation mechanism, the controller executes the abnormality diagnosis mode after outputting a signal for notifying an abnormality related to an operation of the separation mechanism to notify the abnormality related to the operation of the separation mechanism.

5. The image forming apparatus according to claim 1, wherein, in the execution of the abnormality diagnosis mode, the controller outputs information prompting replacement of the driving unit and/or information prompting replacement of an intermediate transfer belt unit comprising the separation mechanism and the intermediate transfer belt in a case where an amount of change in the detection result of the optical sensor is equal to or smaller than a predetermined amount.

6. The image forming apparatus according to claim 1, wherein, in the execution of the abnormality diagnosis mode, the controller outputs information prompting replacement of the phase detection portion in a case where an amount of change in the detection result of the optical sensor is greater than a predetermined amount.

7. The image forming apparatus according to claim 1, wherein the image bearing member is a first image bearing member, the image forming apparatus comprises a second image bearing member configured to bear a toner image, the separation mechanism is switchable among a full-contact mode in which the intermediate transfer belt is in contact with the first image bearing member and the second image bearing member, a partial separation mode in which the intermediate transfer belt is in contact with the first image bearing member and separated from the second image bearing member, and a full-separation mode in which the intermediate transfer belt is separated from the first image bearing member and the second image bearing member, and the controller is configured to output the driving signal such that the separation mechanism is switched to both the full-contact mode and the full-separation mode in the execution of the abnormality diagnosis mode.

* * * * *